US006026266A

United States Patent [19]

Sakai et al.

[11] Patent Number: 6,026,266

[45] Date of Patent: Feb. 15, 2000

[54] DEVELOPING APPARATUS USING ONE-COMPONENT TONER

[75] Inventors: Takashi Sakai, Nara; Hiroshi Ishii, Kashihara; Tetsuro Toyoshima, Kyoto; Hiroshi Tatsumi, Nara; Toshihiko Takaya, Yamatokoriyama, all of Japan

[73] Assignee: Sharp Kabushiki Kaisha, Osaka, Japan

[21] Appl. No.: 09/148,077

[22] Filed: Sep. 4, 1998

[30] Foreign Application Priority Data

Sep. 4, 1997 [JP] Japan ..... P9-238784

[51] Int. Cl.[7] ..... G03G 15/08

[52] U.S. Cl. ..... 399/281; 399/283; 399/284; 399/285; 399/53

[58] Field of Search ..... 399/53, 55, 285, 399/284, 286, 281

[56] References Cited

U.S. PATENT DOCUMENTS

| | | | |
|---|---|---|---|
| 4,743,937 | 5/1988 | Martin | 399/281 |
| 5,164,773 | 11/1992 | Nishio et al. . | |
| 5,170,213 | 12/1992 | Yamaguchi et al. | 399/281 |
| 5,365,318 | 11/1994 | Hiraoka et al. | 399/44 |
| 5,412,458 | 5/1995 | Kamaji et al. | 399/272 |
| 5,592,266 | 1/1997 | Park et al. | 399/284 |
| 5,692,232 | 11/1997 | Okano et al. | 399/53 |

FOREIGN PATENT DOCUMENTS 324569 2/1991 Japan .

*Primary Examiner*—Matthew S. Smith

[57] ABSTRACT

To prevent scattering of toner when an image forming operation is started and ended in a developing process using one-component toner, a rotatable developing roller in contact with a photosensitive member carrying a static latent image, which is used to carry and feed one-component toner, is provided in a developing tank containing one-component toner. Initially, toner is fed to a feed roller, then passed through a toner restricting member which is pressed against the developing roller to restrict the amount of toner to be fed, so that a layer of toner is formed at a fixed thickness and fed into a developing area in contact with the photosensitive member. Thus a static latent image is produced on the developing roller. In this process, a developing bias voltage Va is supplied to the developing roller, a restricting voltage Vb is supplied to the toner restricting member so as to fix the thickness of the toner layer, and a supply voltage Vc is supplied to the feed roller to control the supply of toner. Specifically, the developing bias voltage Va, restricting voltage Vb, and supply voltage Vc are applied to their respective objects before the developing roller begins rotating, thereby minimizing or preventing the scattering or blowing out of toner. Additionally, supply of those voltages Va, Vo, and Vc are stopped after the developing roller stops, which also helps to prevent excess scattering of toner.

21 Claims, 6 Drawing Sheets

FIG. 2A START OF IMAGE FORMING PROCESSING
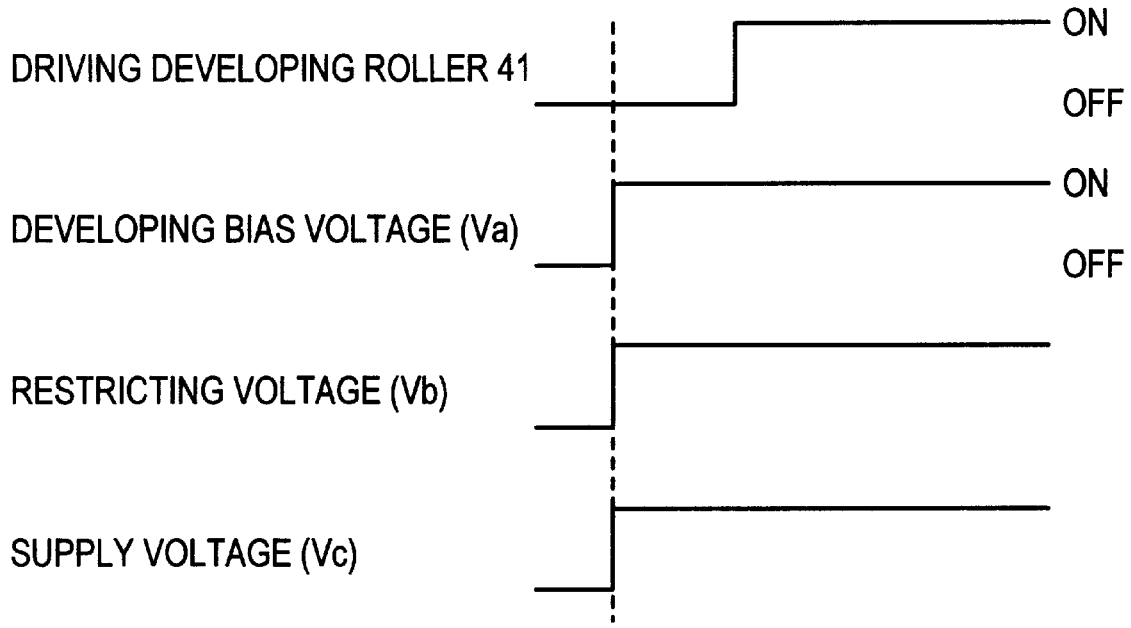
FIG. 2B END OF IMAGE FORMING PROCESSING
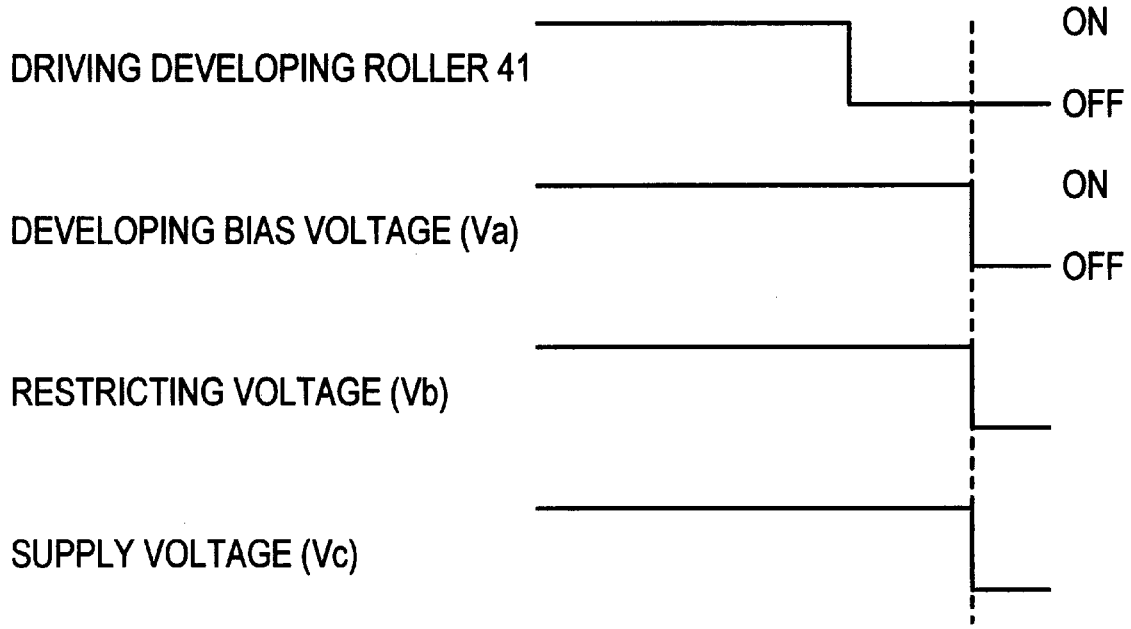

FIG. 4A START OF IMAGE FORMING PROCESSING
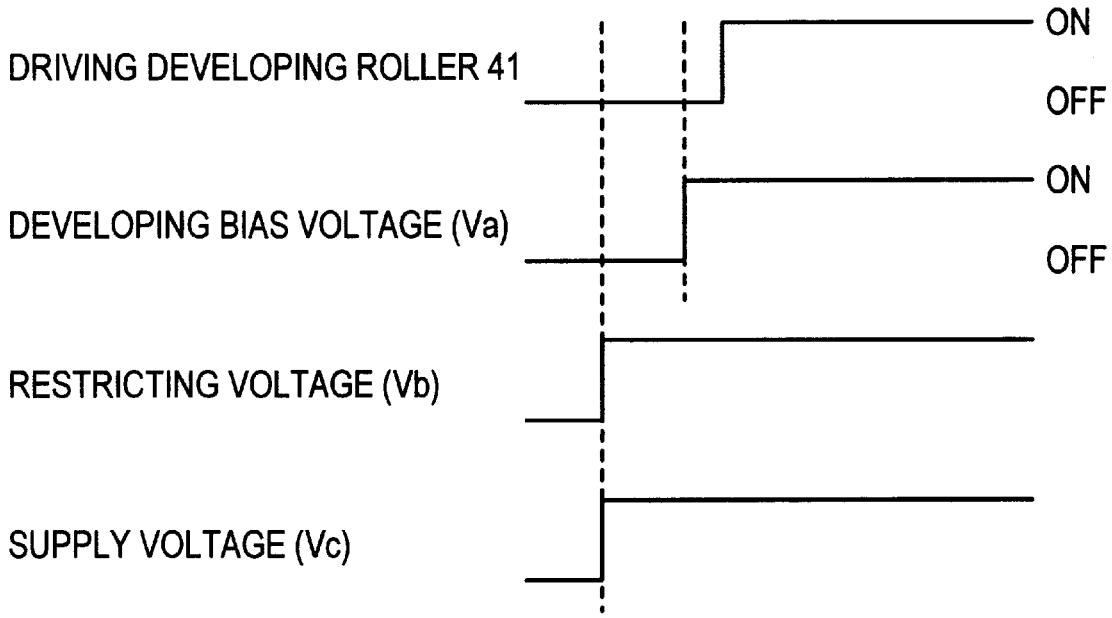
FIG. 4B END OF IMAGE FORMING PROCESSING
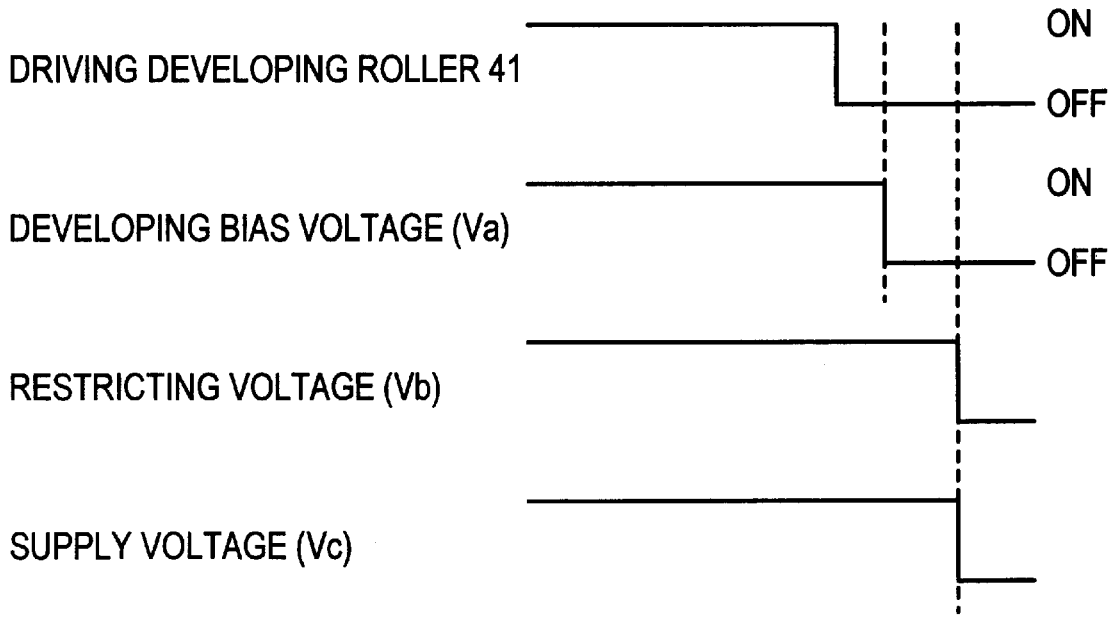

DEVELOPING APPARATUS USING ONE-COMPONENT TONER

BACKGROUND OF THE INVENTION

1. Field of the Invention

The present invention relates to a developing apparatus which visualizes a static latent image formed on an image carrier with a coloring material of toner, more particularly, to a developing apparatus using a one-component developer as toner.

2. Description of the Related Art

An image forming apparatus which has adopted an electrophotographic method used for copying machines, printers, etc. respectively is provided with a developing apparatus composed so as to form a static latent image on a surface of a photosensitive member, which is a carrier for a latent image, and to then supply a developer such as toner (a coloring material) to the photosensitive material so that the toner is adhered thereon selectively to visualize the latent image.

In the above developing apparatus, the toner image obtained by developing the static latent image formed on the photosensitive member is transferred onto a transfer material such as a sheet, etc. After this, part of toner which is not used in a transfer process remains on the surface of the photosensitive member. This unnecessary residual toner must be removed from the surface of the photosensitive member to enable the next image forming to be performed continuously. The developing apparatus is thus provided with a cleaning device for removing such residual toner from the surface of the photosensitive member after completion of the transfer process. The unnecessary residual toner removed by the cleaning device is then collected in a toner container provided in the cleaning device.

The image forming apparatus provided with the developing apparatus as described above reduces the space for installing process means for forming an image around the photosensitive member, while at the same time, image forming apparatus is becoming more and more compact in size. Thus, such recent trend toward smaller-sized image forming apparatuses necessarily demands a smaller developing apparatus.

Specifically, the developing apparatus as described above is provided with a magnetic brush-type developing roller used for carrying a two-component developer composed of toner and magnetic carrier to a developing area, and which is positioned so as to correspond to the photosensitive member using a magnetic force to collect a residual of the developer in a developing tank after a developing process is ended. For this purpose, new toner is constantly supplied thereby to control the rate of toner included in the developer, that is, the toner density and to stabilize the developing process.

Generally, in the above method, that is, in the magnetic brush type method, the magnetic carrier is included more than the toner in the developer. This makes the developing tank containing the developer larger in capacity, resulting in the enlarging of the comprehensive size of the developing apparatus. In this case, the toner density must also be controlled properly, and the developing apparatus needs a stirring member or the like for stirring the toner in the developer so that the charging state of the toner is fixed. And, since a plurality of such stirring members are provided, it has been difficult to reduce the size of the developing apparatus.

On the other hand, there has been proposed a developing apparatus using toner which is a one-component developer containing no magnetic carrier. The developing apparatus is already in practical use. In the developing apparatus using such one-component toner, there is no need to control the toner density. Since no magnetic carrier exists, the capacity of the developing tank can be reduced and the developing apparatus itself can be miniaturized. Accordingly, such a developing apparatus is also excellent in simplicity for maintenance, etc. In other words, in the case of such a developing apparatus, there is no need to replace a degraded developer, especially a developer including degraded magnetic carrier. No maintenance such as developer replacement is thus needed.

Furthermore, only supply of toner is required; neither detection of toner density nor a controlling means for detecting such toner density is needed. The developing apparatus can thus be easily controlled. Specifically, in the developing apparatus using a one-component toner, toner is supplied only as needed.

For example, as shown in FIG. 1, a developing apparatus 4 used to visualize a static latent image formed on a photosensitive member 1 is disposed so as to be opposed to the photosensitive member 1, which is an image carrier. The developing apparatus 4 is provided with a developing roller 41 rotatable so as to be opposed to, the opening of the developing tank 40 containing toner 10, which is a one-component developer. The portion of the developing roller 41 exposed at the opening of the developing tank 40 is disposed, for example, so as to come in contact with the photosensitive member 1. This contact area is used as a developing area.

The developing roller 41 is used to carry one-component toner 10 on its surface and feed the toner to the developing area opposed to the photosensitive member 1. After a developing process is ended, toner which is not used in the developing process is fed and collected into the developing tank 40. Since the collected toner must be removed at once from the surface of the developing roller 41, the developing apparatus is provided with a feed roller 42 disposed so as to be pressed against the developing roller 41. Toner carried on the surface of the developing roller 41 is scraped off and new toner 10 is fed by the feed roller 42 onto the surface of the developing roller 41.

The one-component toner 10 fed by the feed roller 42 is sucked onto the surface of the developing roller 41. In order to restrict the amount of the toner 10 to be stuck on the surface of the developing roller 41, the developing apparatus is also provided with a toner restricting member 43, disposed so as to be pressed against the surface of the developing roller 41. Toner passing the toner restricting member 43 is restricted so that a fixed amount is fed to the developing area opposed to the photosensitive member 1 as described above. The toner is then stuck on the surface of the photosensitive member 1 according to the static latent image formed thereon. Thus, the latent image is developed.

Usually, a developing bias voltage Va is applied to the developing roller 41 to perform the developing process properly. This developing bias voltage is set to a value that can cause toner to be stuck on the static latent image and not to be stuck on the background area (other than the latent image) of the photosensitive member.

In order to charge one-component toner 10 held on the developing roller 41 to a predetermined potential, and to a predetermined polarity, the toner restricting member 43 pressed against the surface of the developing roller 41 is located at the downstream side of the rotational direction of the developing roller 41. In addition, a restricting voltage Vb is applied to the toner restricting member 43 so as to charge one-component toner 10 to a predetermined polarity. Consequently, one-component toner, when passing the toner restricting member 43, is kept at a fixed amount, charged to a predetermined potential at a predetermined polarity, and fed to the developing area.

Since the developing apparatus is composed as described above, a one-component developer (toner) is applied onto the developing roller and fed to the developing area. Toner is thus stuck on the static latent image formed on the photosensitive member, so that application of toner on the background other than the latent image is prevented, thereby enabling the developing process to perform normally.

In recent years, processings of copying machines and printers are getting faster and faster as described above, while at the same time, there has been a strong demand toward smaller-sized devices. According to such the recent trend, a technology has also been required to secure an image visualizing performance properly in the developing area of each developing apparatus.

In other words, in order to cope with faster processings of an image forming apparatus, it has been derived to feed a developer effectively in its developing apparatus. There has also been a demand for a developing apparatus using one-component toner so that the developing apparatus itself is miniaturized corresponding to the trend toward a smaller-sized image forming apparatus.

This is why the prior art developing apparatus controls the developing roller, the voltage supplied to the developing roller, etc. as shown in FIGS. 5A, 5B, 6A and 6B to stabilize the developing process and feed one-component toner effectively. For example, in response to the start of an image forming operation, application of a developing bias voltage to the developing roller and a supply voltage to the toner restricting member is controlled synchronously with the timing for turning on the developing roller drive motor, so as to be on when the drive motor is on as shown in FIG. 5A.

Otherwise, as shown in FIG. 6A, a fixed time after the developing roller begins rotating, the application of the developing bias voltage and the supply voltage to the toner restricting member is turned on.

Consequently, the developing process is performed stably using toner charged in a predetermined state according to the rotation of the photosensitive member 1. In addition, after the end of the developing process, the developing apparatus is controlled so that the developing bias voltage or the like is turned off synchronously with the stop (OFF) timing for the developing roller, or the developing roller is turned off a fixed time after the developing bias voltage or the like is turned off, as shown in FIG. 5B and FIG. 6B.

As described above, a predetermined voltage is supplied to the developing roller and the toner restricting member respectively, then one-component toner is applied onto the surface of the developing roller and adjusted so that a fixed amount of toner is supplied into the developing area at a fixed charging potential. When an image forming operation is started, however, toner may blow out and scatter while passing the toner restricting member according to the rotation of the developing roller begins before a developing bias voltage is supplied to the developing roller, for example, as shown in FIGS. 5A and 5B. In addition, when an image forming operation ends, if the developing bias voltage is turned off first, toner may scatter before the developing roller stops.

This is because it is difficult to hold the charging potential of toner at a fixed value, since one-component toner is sucked and stuck on the developing roller, for example, statically. Thus, the toner which cannot be applied on the developing roller so statically blows out and scatters when the developing roller begins rotating. As a result, the image quality is degraded in the initial stage of the developing, for example, just after an image forming operation is started. In addition, after the developing process ends, toner which cannot be held on the developing roller is not collected, causing scattering of toner.

Such a problem appears more pronounced when the developing roller is rotated faster, thereby feeding much more toner while the developing apparatus is operated faster. In other words, as the developing roller is rotated faster, the amount of toner scattered also increases.

SUMMARY OF THE INVENTION

Under such circumstances, it is an object of the present invention to provide a developing apparatus using one-component toner. The developing apparatus can minimize scattering of toner caused by blown-out toner when a developing process is started or ended, thereby stabilizing the developing process.

In other words, an object of the invention is to cope with faster processings of the developing apparatus by eliminating unstable factors of one-component toner when a developing process is started or ended, thereby holding toner on the developing roller surely and prevent scattering of toner.

To achieve the above object, in one aspect of the invention there is provided a developing apparatus using one-component toner comprising:

a carrier for carrying a static latent image;

a developing roller opposed to the carrier, for carrying one-component toner and feeding the one-component toner to a developing area of the carrier by rotating; and a toner restricting member for restricting an amount of the one-component toner to be carried on the developing roller, a developing bias voltage is applied to the developing roller thereby to stick one-component toner on the static latent image formed on the carrier, the developing apparatus being controlled so that the application of the developing bias voltage is started before driving the developing roller is started.

According to the developing apparatus composed as described above, the developing roller is rotated, in relation to the start of an image forming operation. In this case, since the developing bias voltage supplied to the developing roller is controlled especially before the developing roller is rotated, the one-component toner which is unstable in state is sucked onto the developing roller before the start of rotation to prevent scattering of the toner caused by blown-out toner when the developing roller begins rotating.

Preferably, the developing apparatus using one-component toner is controlled so that application of a restricting voltage to the toner restricting member is started in order to push one-component toner toward the developing roller before driving of the developing roller is started.

Consequently, a difference of potential is generated between the toner restricting member and the developing roller and causes toner to be sucked to and held on the developing roller thereby to prevent the toner effectively from scattering along the flow of the toner when the one-component toner is passing the toner restricting member.

Especially, one-component toner is held on the developing roller due to a cooperative function of the bias voltage supplied to the developing roller and the supply voltage to the toner restricting member, thereby scattering of the toner is prevented effectively.

Preferably the developing apparatus using one-component toner further comprises a toner feed roller and is controlled so that application of a supply voltage to the toner feed roller is started in order to feed one-component toner to the developing roller before driving the developing roller is started.

Consequently, it is possible to prevent scattering of the one-component toner when collection of the toner into the developing apparatus is started. Specifically, if it is preset to apply a voltage for feeding one-component toner to the feed roller, one-component toner can be fed to the developing roller properly, as well as it is possible to increase the amount of one-component toner to be fed to the developing roller. In this case, if the developing roller is composed of a porous elastic member, it is possible to hold the one-component toner in those many holes surely thereby to increase the amount of toner to cope with fast processings of an image forming apparatus.

Preferably the supply voltage is variably controlled to adjust an amount of the one-component toner to be fed to the developing roller.

Consequently, feeding of the one-component toner can cope with the fast processings as described above easily. In other words, it is only needed to adjust the supply voltage supplied to the feed roller thereby to increase the amount of one-component toner to be fed.

Preferably the developing apparatus is controlled so that application of the restricting voltage is started before the application of the developing bias voltage is started.

Consequently, it is possible to prevent the toner from scattering on the air flowing along the rotating direction of the developing roller thereby to prevent scattering of the toner effectively.

In another aspect of the invention there is provided a developing apparatus using one-component toner comprising:

a carrier for carrying a static latent image;

a developing roller opposed to the carrier, for carrying one-component toner and feeding one-component toner to a developing area of the carrier by rotating; and a toner restricting member for restricting an amount of one-component toner to be carried on the developing roller, wherein a developing bias voltage is applied to the developing roller to make the one-component toner stick on a static latent image formed on the carrier, the developing apparatus being controlled so that the application of the developing bias voltage is stopped after driving the developing roller is stopped.

According to the developing apparatus using one-component toner, composed as described above, the developing bias voltage is kept supplied even after the developing roller stops. It is thus possible to suck one-component toner onto the developing roller so as to be stuck thereon. Consequently, it is possible to prevent scattering of toner in the collecting area, as well as around the toner restricting member. As a result, the area around the developing apparatus is protected from being contaminated by scattered toner when an image forming operation is ended. When another image forming operation is started, therefore, scattered toner is not stuck on paper thereby to prevent degradation of the image quality.

Preferably a restricting voltage is applied to the toner restricting member to push the one-component toner toward the developing roller and the developing apparatus using one-component toner is controlled so that the application of the restricting voltage is stopped after driving the developing roller is stopped.

Consequently, the one-component toner is held on the developing roller even after the developing roller stops, thereby preventing scattering of the toner at the toner restricting member.

Preferably the developing apparatus using one-component toner is controlled so that the application of the restricting voltage is stopped before the application of the developing bias voltage is stopped.

Consequently, the toner is kept held on the developing roller even after the developing bias voltage is turned off, thereby scattering of the toner is prevented more effectively.

Preferably the developing apparatus using one-component toner further comprises a toner feed roller for feeding the one-component toner, the apparatus supplying a supply voltage to the toner feed roller to feed the one-component toner to the developing roller.

Preferably the developing apparatus using one-component toner is controlled so that the developing bias voltage Va, restricting voltage Vb and supply voltage Vc are controlled, so as to satisfy $|Va| \leqq |Vb| \leqq |Vc|$.

Consequently, the one-component toner can be fed to the feed roller surely along the air flow caused by the rotation of the developing roller. In addition, the toner restricting member can restrict the toner to fixing an amount, thereby a fixed amount of the toner fed to the developing area for stable developing during fast processings.

According to the developing apparatus with one-component toner of the invention as described above, it is possible to prevent scattering of the toner when an image forming operation is started using the one-component toner and when the image forming operation is ended. Thus, the image can be developed using toner in a stable charging state.

Furthermore, if the developing roller for feeding the one-component toner, as well as the supply timing of the voltage to the toner restricting member for restricting the amount of toner to be stuck are controlled, scattering of the toner is prevented more effectively.

Consequently, the invention can provide a developing apparatus easy to cope with demands of smaller size and faster processings of an image forming apparatus.

BRIEF DESCRIPTION OF THE DRAWINGS

Other and further objects, features, and advantages of the invention will be more explicit from the following detailed description taken with reference to the drawings wherein:

FIGS. 2A and 2B are views illustrating control timings for supplying voltages to a developing roller and a toner restricting member in the developing apparatus shown in FIG. 1 and for explaining the first embodiment of the invention, FIG. 2A is a timing chart indicating a starting point for an image forming operation, FIG. 2B is a timing chart indicating an ending point for an image forming operation;

FIGS. 4A and 4B are views illustrating control of voltages supplied to the developing roller and the toner restricting member in the developing apparatus shown in FIG. 1 to explain the second embodiment of the invention. FIG. 4A is a timing chart indicating a starting point for an image forming operation, FIG. 4B is a timing chart indicating an ending point for an image forming operation;

DETAILED DESCRIPTION OF THE PREFERRED EMBODIMENTS

Figure 1:
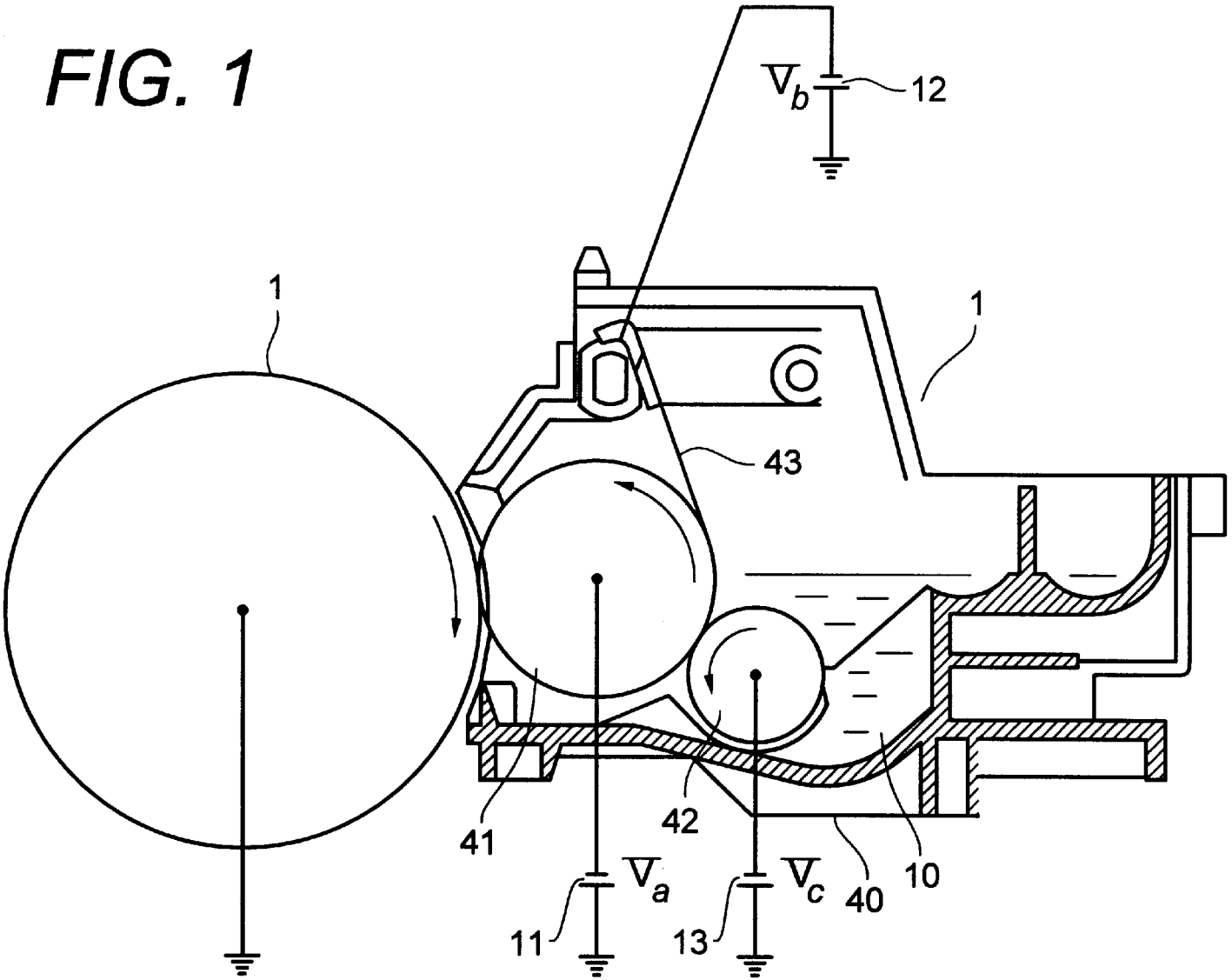
FIG. 1 is a view illustrating a configuration of a developing apparatus of the present invention, using one-component toner, which is disposed so as to be opposed to a photosensitive member carrying a static latent image thereon.

Now referring to the drawings, preferred embodiments of the invention are described below.

Figure 3:
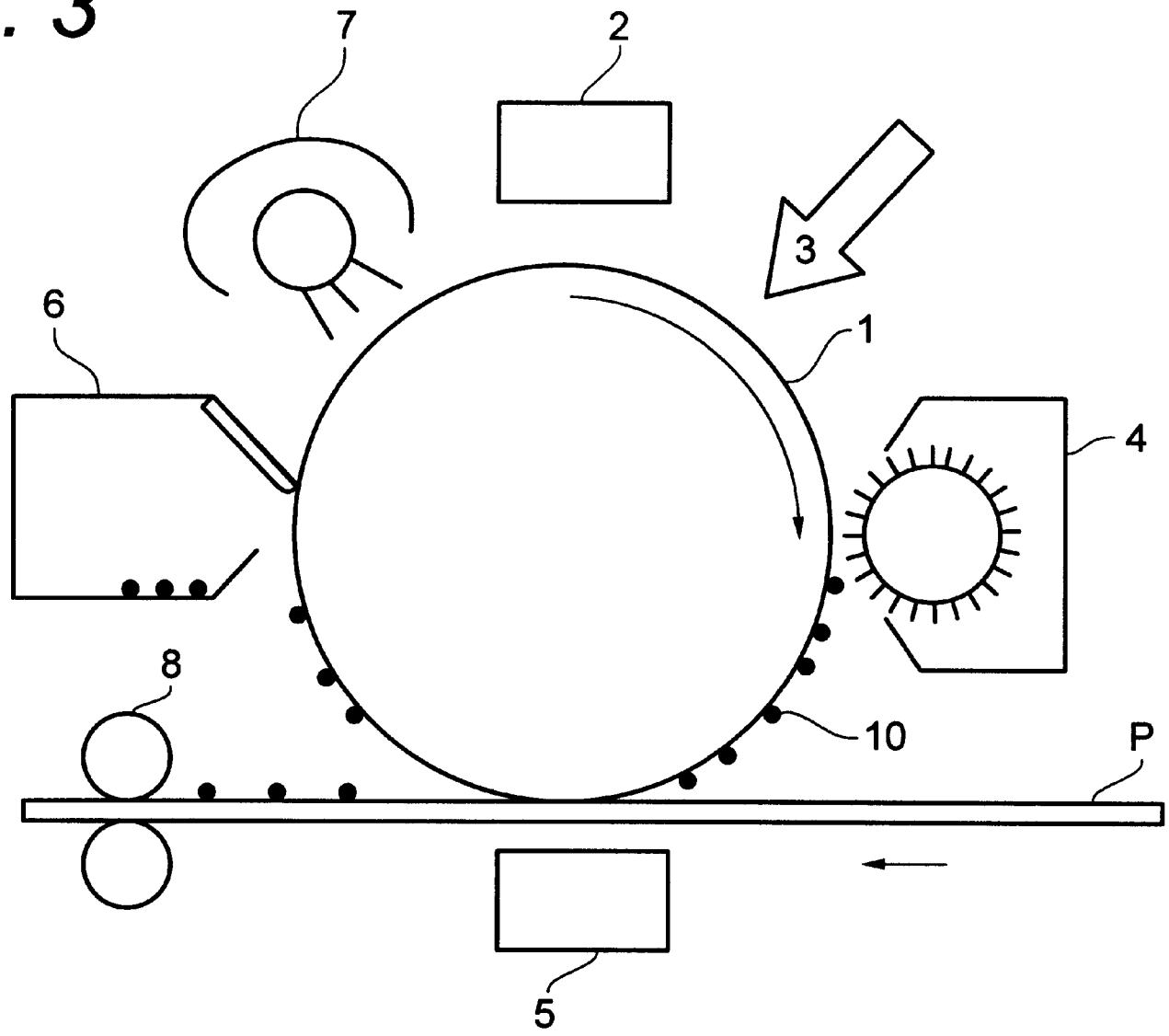
FIG. 3 is a configuration of an image forming apparatus provided with a developing apparatus composed as shown in FIG. 1.
Figure 5A:
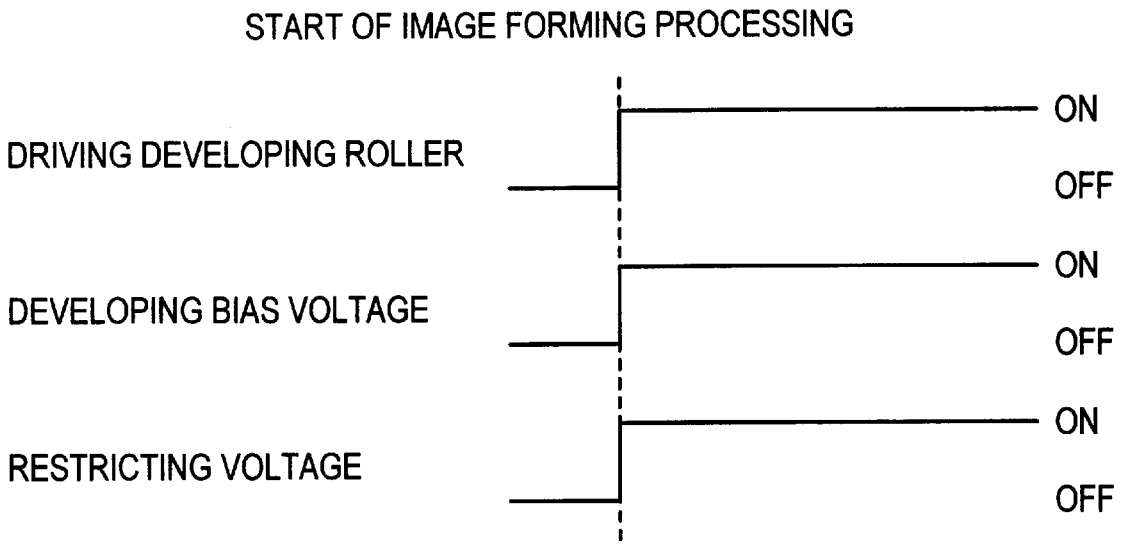
FIG. 5A PRIOR ART
FIGS. 5A and 5B are control timing charts for starting and ending an image forming operation in a prior art developing apparatus, FIG. 5A being a timing chart for the starting point, FIG. 5B being a timing chart for the ending point.
Figure 5B:
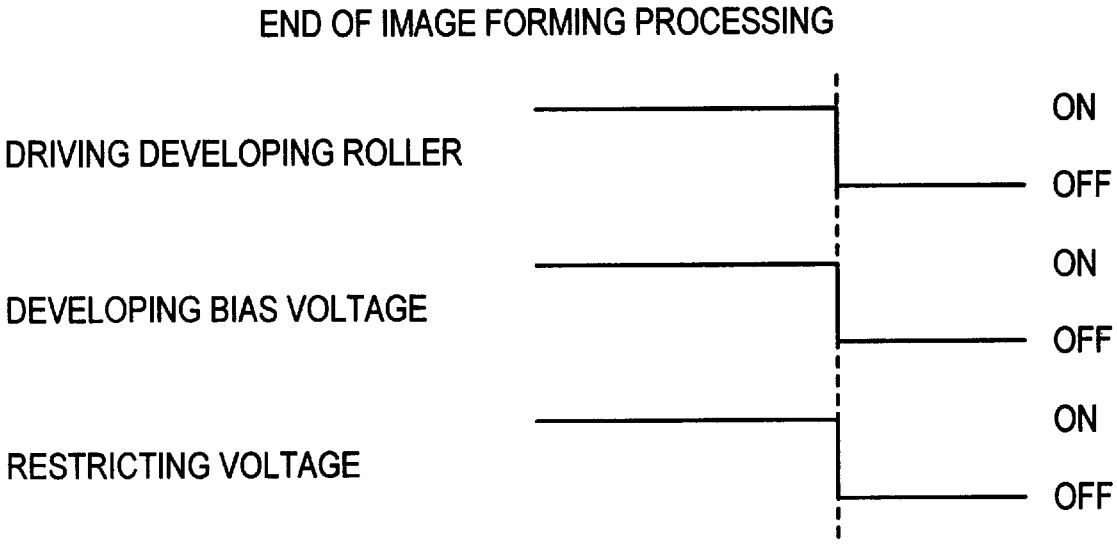
FIG. 5B PRIOR ART
Figure 6A:
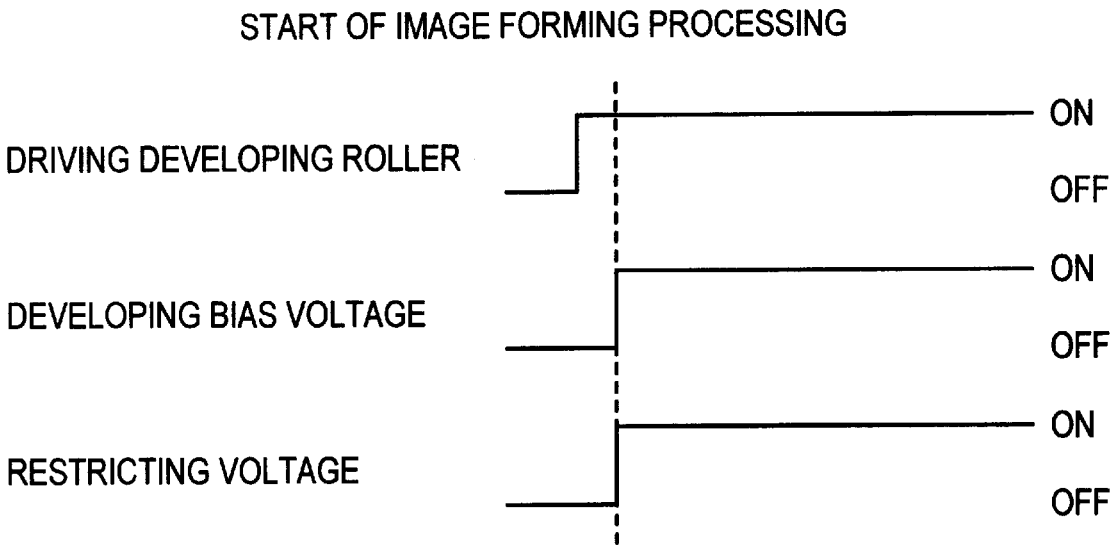
FIG. 6A PRIOR ART
FIGS. 6A and 6B are other control timing charts for starting and ending an image forming operation in the prior art developing apparatus, FIG. 6A being a timing chart for the starting point, FIG. 6B being a timing chart for the ending point.
Figure 6B:
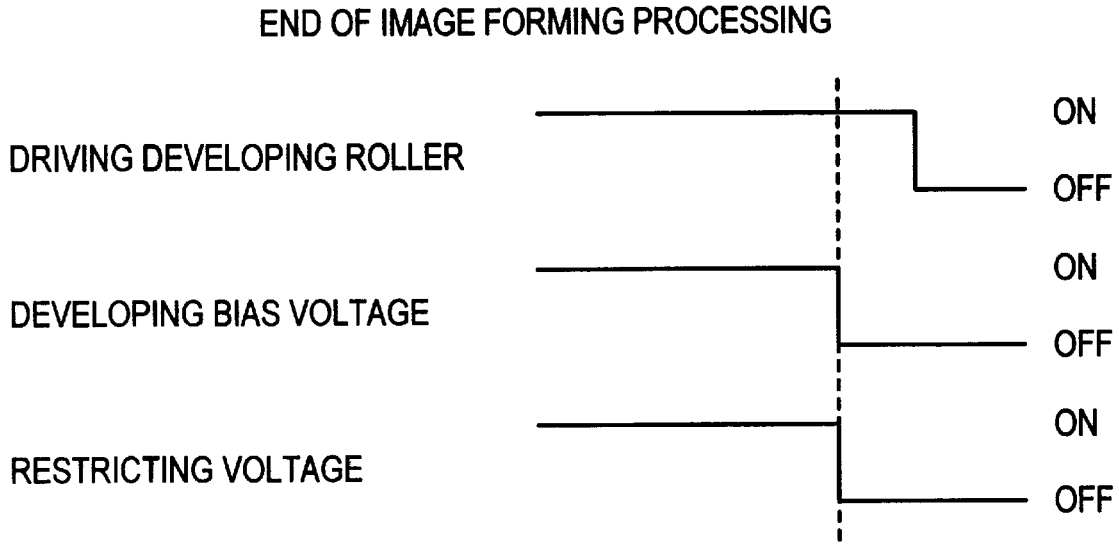
FIG. 6B PRIOR ART

The first embodiment of the developing apparatus of the present invention will be described with reference to FIGS. 1 to 3. FIG. 1 illustrates a configuration of the developing apparatus of the invention, opposed to a photosensitive member, which is a carrier for a latent image, especially that of an image forming apparatus. FIGS. 2A and 2B illustrate drive timings and voltage supply timings of various mechanisms composing the developing apparatus of the invention. FIG. 2A is a timing chart indicating how each of the mechanisms is driven for starting an image forming operation and FIG. 2B is a timing chart indicating how each of the mechanisms is driven for ending an image forming operation. FIG. 3 illustrates a schematic configuration of an image forming apparatus provided with the developing apparatus shown in FIG. 1.

Hereunder, a schematic configuration of the image forming apparatus will be described with reference to FIG. 3. A reference numeral 1 indicates a photosensitive member composing a drum-like carrier disposed almost in the center of the image forming apparatus and rotated at a fixed speed in the direction of an arrow when an image forming operation is performed. The carrier is used to carry a static latent image thereon. Various image forming process means are disposed around this photosensitive member 1 so as to be opposed thereto respectively.

The above image forming process means (devices) include a charger 2 that charges the surface of the photosensitive member 1 in uniform; an optical system that beams a light image 3 according to an image (not illustrated); a developing apparatus 4 of the invention, used to visualize a static latent image formed on the surface of the photosensitive member 1 after being exposed by the optical system; a transfer member 5 for transferring the developed image (image of toner 10) onto a sheet-like paper P fed as needed; a cleaning member 6 for removing residual developer (toner) remaining on the surface of the photosensitive member 1 after the transfer process is ended; and an eliminator 7 for eliminating electric charge remained on the surface of the photosensitive member 1, etc., which are all disposed in order in the rotating direction of the photosensitive member 1.

Many sheets of paper P are stacked in, for example, a tray or a cassette. A sheet of paper is then fed by a paper feeding means into the transfer area opposed to the photosensitive member 1, where the transfer member 5 is disposed. At this time, the paper P is fed so as to be aligned to the tip of the toner image formed on the surface of the photosensitive member 1. The paper P, after the image is transferred, is separated from the photosensitive member 1, then fed into a fixing apparatus 8.

The fixing apparatus 8 fixes a non-fixed toner image transferred onto a sheet of paper as a permanent image. The fixing apparatus has a heat roller heated up to a temperature for fusing toner and fixing the toner image on its surface opposed to the toner image. The fixing apparatus 8 also includes a pressure roller pressed against the heat roller and used to make the paper P come in contact closely with the heat roller. The paper P passing through this fixing apparatus 8 is ejected outside the image forming apparatus, into an ejection tray (not illustrated) via an ejection roller.

The optical system (not illustrated) beams a light on a copy original and outputs a reflecting light from the original as a light image 3 if a copying machine is used as an image forming apparatus. If a printer or a digital copying machine is used as an image forming apparatus, the optical system turns on/off the semiconductor laser thereby to output a light image according to image data. Especially, when a digital copying machine is used as an image forming apparatus, the optical system including the semiconductor laser receives image data obtained by reading a reflecting light from a copy original using an image read sensor (CCD element, etc.) and outputs a light image according to the image data. If a printer is used as an image forming apparatus, the optical system receives image data from another processing device, for example, a word processor, a personal computer, etc. and converts the data to a light image according to the image data and outputs the light image. Not only a semiconductor laser, but also an LED element, a liquid crystal shutter, etc. are usable for converting image data to a light image.

If an image forming operation is started in the image forming apparatus as described above, the photosensitive member 1 is rotated in the direction of an arrow and the surface of the photosensitive member 1 is charged by the charger 2 to a potential of a specific polarity in uniform. After this charging process, the optical system (not illustrated) outputs a light image 3, so that a static latent image is formed on the surface of the photosensitive member 1 according to this light image. This static latent image is developed in the developing apparatus 4 in the next stage thereby to visualize the static latent image artificially. One-component toner is used for this developing process in the invention. The toner is sucked selectively by, for example, an electrostatic force onto a static latent image formed on the surface of the photosensitive member 1 so as to be developed.

The transfer member 5 disposed in the transfer area then transfers the toner image developed on the surface of the photosensitive member 1 as described above statically on the paper P fed synchronously with the rotation of the photosensitive member 1 as needed. In this transfer process, the transfer member 5 charges the back side of the paper P to a polarity opposite to the polarity of charged toner, so that the toner image is transferred onto the paper P.

After this transfer process is ended, part of the toner image that has not been transferred onto the surface of the photosensitive member 1 remains. This residual toner is removed by the cleaning member 6 from the surface of the photosensitive member 1. Then, the surface potential of the photosensitive member 1 is eliminated to a uniform potential, for example, almost 0 potential by an eliminator 7 thereby to reuse the photosensitive member 1.

On the other hand, the paper P, after the transfer process is ended, is separated from the photosensitive member 1 and fed to the fixing apparatus 8. In this fixing apparatus 8, the toner image on the paper P is fused, then pressed and fixed due to a pressure generated between rollers. Passing this fixing apparatus 8, the paper is ejected as an image formed paper P onto a tray provided outside the image forming apparatus.

First Embodiment

Next, the first embodiment of the invention will be described with reference to FIGS. 1 and 2A and 2B. In other words, detailed description will be made for an embodiment of the developing apparatus of the invention, which uses one-component toner.

At first, a configuration of the developing apparatus using one-component toner will be described with reference to FIG. 1. The developing apparatus 4 comprises a developing roller 41 provided rotatably in a developing tank 40 containing one-component toner, for example, non-magnetic one-component toner 10; a feed roller 42 for feeding one-component toner 10 to the developing roller 41; and a screw roller, etc. (not illustrated) for feeding one-component toner 10 supplied as needed on the right side of the developing tank 40 (in FIG. 1).

The developing roller 41 is composed of a metallic roller made of, for example, stainless steel, aluminum, etc. or a metallic roller, the surface of which being coated with a porous elastic material such as sponge. If carbon-distributed macromolecular foam polyurethane, etc. or ion conductive solid rubber is used as the elastic member such as sponge, a predetermined resistance value that prevents toner fusion can be kept and it will function effectively when a developing bias voltage is supplied to the developing roller as to be described later.

A drive motor (not illustrated) is linked to this developing roller 41, so that the developing roller 41 is rotated in the direction of an arrow in FIG. 1. One-component toner 10 is sucked onto the surface of the rotating developing roller 41 and fed into the developing area opposed to the surface of the photosensitive member 1. Then, since the developing roller 41 is pressed against the surface of the photosensitive member 1, the pressed area functions as a developing area for developing a static latent image with one-component toner sucked onto the latent image formed on the surface of the photosensitive member 1.

One-component toner 10 is, for example, one-component non-magnetic toner particles of about 10 $\mu$m in average particle diameter, composed of polyester toner or styrene acrylic toner.

The feed roller 42 provided so as to feed one-component toner 10 to the developing roller 41 is pressed against the developing roller 41 properly. This feed roller 42 is composed of urethane sponge, etc. The feed roller 42 linked to the drive motor which is also linked to the developing roller 41 is rotated in the same direction as that of the developing roller 41, that is, counter-clockwise in FIG. 1, so that the feed roller 42 and the developing roller 41 pass each other in a contact area between them. Consequently, toner carried on the surface of the developing roller 41 after a developing process is ended is removed, so that new toner can be fed to the developing roller 41.

In the developing tank 40, there is provided a toner restricting member (blade) 43 used for restricting the amount of one-component toner 10 to be carried on the surface of the developing roller 41 and fed into the developing area to a fixed amount after they are fed by the feed roller 42. The toner restricting member 43 is pressed against the developing roller 41 or disposed at a predetermined distance from the developing roller 41. In the invention, the toner restricting member 43 is pressed against the developing roller 41 at a predetermined pressure.

This toner restricting member 43 is fixed to the developing tank 40 at its one end and opposed to the surface of the developing roller 41 at the other free end. The toner restricting member 43 is composed of, for example, a metallic plate made of phosphor bronze or stainless steel (SUS) of the order of 0.1 to 0.2 mm in thickness. The tip of the toner restricting member 43 is pressed against the developing roller 41 at a predetermined pressure along the longitudinal direction (the direction of the axis of rotation of the developing roller). Consequently, the toner restricting member 43 can restrict the amount of one-component toner 10 to be carried on the surface of the developing roller 41 via the feed roller 42 to a fixed value, so that one-component toner 10 are fed into the developing area being in contact with the photosensitive member 1.

According to the configuration of the developing apparatus 4, one-component toner 10 is fed onto the surface of the rotating developing roller 41 via the feed roller 42 in the developing tank 40 and the toner restricting member 43 keeps a fixed amount of toner 10 to be stuck on the surface of the developing roller 41. A fixed amount of toner 10 is thus fed to the developing area. The toner 10 fed into this developing area are then sucked statically onto a static latent image formed on the surface of the photosensitive member 1. Consequently, toner is stuck on the static latent image, thereby a toner image is formed. In other words, the latent image is developed.

A developing process is performed, and toner not used for the developing is returned into the developing tank 40 and scraped off the surface of the developing roller 41 according to the rotation of the feed roller 42. Then, new one-component toner 10 is fed onto the surface of the developing roller 41.

In order to feed one-component toner 10 stably to the developing roller 41 at this time, the developing roller 41 made of sponge is composed of a porous member as described above, so that one-component toner 10 are carried in many holes existing on the surface of the porous member. The performance for feeding one-component toner 10 can thus be improved. And furthermore, the toner can be fed stably into the developing area.

Furthermore, a developing bias voltage Va is applied to the developing roller 41 so that toner is not stuck in the background area other than on a static latent image therein and toner is sucked onto the static latent image only. This bias voltage Va is supplied to the metallic developing roller 41 via a power source circuit 11. Specifically, the developing roller 41 is formed so that the surface of the metallic roller is covered by the above-mentioned foam conductive elastic member. The developing bias voltage Va is supplied to the metallic roller from the power source member 11. In addition, the foam elastic member is a conductor having a predetermined resistance value.

For example, the surface of the photosensitive member 1 is charged negatively in uniform and a portion to which a light image is beamed (toner is stuck) according to an image is discharged negatively. At this time, for example, while the surface of the photosensitive member 1 is charged at a potential of about −600V, the potential becomes about −100V at a static latent image portion where a light image is beamed. And, in order to develop the image negatively in the developing apparatus 4, when one-component toner 10 charged to a negative potential is carried on the surface of the developing roller 41, then fed and used for developing, a potential of about −350V is applied to the developing roller 41 as the developing bias voltage Va, the negative charged toner 10 are sucked statically on the static latent image whose potential becomes about −100V due to the developing bias voltage. At the background portion except for the static latent image, however, toner 10 are carried on the developing roller 41 due to the function of the developing bias voltage Va. Thus, the background portion is not developed.

Furthermore, as described above, in order to stabilize the charging potential of one-component toner 10 carried on the developing roller 41, that is, to give a predetermined charging potential, a toner restricting member 43 is provided to restrict the amount of toner 10 to be stuck on the developing roller 41. And, according to a friction between this toner restricting member 43 and the developing roller 41, one-component toner 10 is charged, for example, negatively. This negative charging is decided by the toner restricting member 43, the developing roller 41, and a series of charging elements of one-component toner 10. If the photosensitive member 1 is charged negatively, however, toner to be charged negatively are selected.

Then, a predetermined restricting voltage Vb is supplied to the toner restricting member 43 from a power source circuit 12 for supplying the restricting voltage. The restricting voltage supplied to the toner restricting member 43 from this power source circuit 12 is negative, since it is used to charge one-component toner 10 negatively in the example mentioned above. The potential of the restricting voltage is set lower than the potential supplied to the developing roller 41, that is, a voltage Vb of about −450V to charge toner 10 negatively, for example.

Consequently, the amount of toner 10 fed to the developing roller 41 is restricted to a fixed value, and after passing the toner restricting member 43, the one-component toner 10 is negatively charged. Then, the negatively charged one-component toner 10 is sucked onto the static latent image and developed stably in a developing process due to the developing bias voltage Va.

Furthermore, in order to feed one-component toner 10 statically to the developing roller 41, a supply voltage Vc is applied to the feed roller 42 used for feeding one-component toner 10 to the developing roller 41 from the power source circuit 13. As the voltage Vc supplied to the feed roller 42, a voltage lower than the voltage Vb supplied to the toner restricting member 43 as a potential is selected. For example, a potential of about −450V is selected.

The developing bias voltage Va, the supply voltage Vc, and the restricting voltage Vb are applied to the developing roller 41, the feed roller 42, and the toner restricting member 43 such way respectively. With those voltages supplied as described above, the developing process is stabilized. Especially, one-component toner 10 is sucked and stuck only on a static latent image, and the potential of charged toner 10 is compensated thereby to stabilize this sticking state of toner 10. Furthermore, those voltages Va, Vb, and Vc are used to stabilize feeding of toner 10.

At this time, the voltage Vb supplied to the toner restricting member 43 and the developing bias voltage Va supplied to the developing roller 41 are set so that charged toner 10 is sucked onto the developing roller 41. For example, if one-component toner 10 is charged negatively, a developing bias voltage Va is set to a lower potential than that of the restricting voltage Vb in the negative state thereby to push toner 10 toward the developing roller 41 from the toner restricting member 43. For example, the developing bias voltage is set to an absolute value to satisfy |Va|<restricting voltage |Vb|. Consequently, a fixed potential difference is generated between the toner restricting member 43 and the developing roller 41, so that the amount of toner 10 to be stuck is always fixed and a uniform thin toner layer is formed. In addition, according to this potential difference, toner 10 tend to be charged negatively as described above.

Furthermore, the amount of one-component toner 10 to be stuck on the developing roller 41 is stabilized, as well as the charging state of one-component toner 10 is stabilized. Since toner 10 is fed into the developing area such way, stable images can be developed.

Furthermore, since the feed roller 42 is provided and rotated so as to be pressed against the developing roller 41, while new one-component toner 10 are fed to the developing roller 41, toner 10 collected after a developing process is ended and carried on the surface of the developing roller 41 are scraped off so as to be replaced with new toner 10 effectively. In this case, a predetermined potential difference is generated even at the toner restricting member 43 thereby to stabilize supply of toner 10 to the developing roller 41. Consequently, one-component toner is pushed toward the developing roller 41 and supply of toner can be stabilized.

For the above purpose, the voltage Vc is supplied to the feed roller 42 so as to feed one-component toner 10 to the developing roller 41. The voltage Vc is selected to control the amount of toner to be fed. For example, the developing bias voltage Va supplied to the developing roller 41 and the voltage Vc supplied to the feed roller 42 satisfy |Vc|>|Va| in absolute values and a static force is applied to both rollers 41 and 42 respectively according to a potential difference between those rollers 41 and 42. Consequently, toner 10 are fed to the developing roller 41 effectively and sucked onto the surface of the developing roller 41. And, the larger the potential difference is, the larger the amount of toner to be fed.

In order to feed one-component toner 10 effectively without applying any supply voltage Vc to the feed roller 42 in this case, the feed roller 42 is pressed very strongly against the developing roller 41, for example. This results in a problem where the stress applied on toner 10 will shorten the service life of toner, however. Thus, stable toner charging properties are not available.

Furthermore, in the case of a low speed image forming apparatus, toner 10 can be fed enough to the developing roller 41 while the feed roller 42 is pressed against the developing roller 41 properly without applying any supply voltage Vc to the feed roller 42. However, such a method cannot possibly be used for a high speed developing apparatus in a high speed image forming apparatus. Thus, a supply voltage Vc is applied to the feed roller 42 thereby to feed one-component toner 10 effectively and cope with such a high speed developing process.

This is why the voltage Vc supplied to the feed roller 42 is varied to adjust the supply amount of toner 10. Otherwise, the force to press the feed roller 42 against the developing roller 41 is varied. However, as described above, varying such pressure results in shortening the service life of one-component toner 10, as well as making for a complicated mechanism. Varying and adjusting the supply voltage Vc would therefore become much more advantageous.

The invention can increase the supply amount of toner easily such way when in high speed developing, since the supply voltage Vc can be varied and the supply amount of one-component toner 10 to the developing roller 41 can be adjusted easily. In this case, the supply amount of toner may be increased more to improve the density of toner images formed with toner 10.

Furthermore, absolute values are taken so as to satisfy $|Va| \leqq |Vb| \leqq |Vc|$ in the above embodiment to indicate the relationship among the developing bias voltage Va supplied to the developing roller 41, the supply voltage Vc supplied to the feed roller 42, and the restricting voltage Vb supplied to the toner restricting member 43. Consequently, one-component toner 10 in the developing tank 40 is fed effectively to the developing roller 41 from the feed roller 42. In addition, toner 10 is flown along the rotating direction of the developing roller 41 so that charging, including frictional charging, of toner to a predetermined potential is carried out, as well as toner 10 is stuck on the surface of the developing roller 41 as a uniform thin layer using the toner restricting member 43 that restricts the amount of one-component toner 10.

Thus, a static force for feeding one-component toner 10 to the developing roller 41 from the feed roller 42 is set as large as possible, so that one-component toner 10 is supplied to the developing roller 41 stably. Consequently, the toner restricting member 43 can form a uniform thin layer of one-component toner 10 on the developing roller 41. In other words, if toner is not supplied enough, the uniform thin toner layer cannot be formed.

Consequently, in order to feed one-component toner 10 to the developing roller 41 enough, the above voltage values must satisfy $|Vb-Va| \leqq |Vc-Va|$. And, to satisfy this expression, it is important to keep the relationship among the absolute values as described above. If the relationship is kept and toner 10 is supplied stably, then the amount of toner 10 to be stuck on the developing roller 41 is fixed. A fixed amount of toner is thus fed into the developing area thereby to stabilize the developing process.

In the developing apparatus 4 composed as described above, therefore, it is possible to prevent scattering of toner 10 caused by blown-out toner 10 just after the developing roller 41 rotates or stops when an image forming operation is started or ended.

In the first embodiment of the invention, there is characterized in that timing control is thus made so that a developing bias voltage Va is applied to the developing roller 41 thereby to stabilize the developing process synchronously with the timing for starting the rotation of the developing roller 41 as shown in FIGS. 2A and 2B.

In other words, as shown in FIG. 2A, the developing roller 41 is rotated according to the rotation of the photosensitive member 1 synchronously with the timing for starting an image forming operation. And, before the developing roller 41 begins rotating, supply of the developing bias voltage Va to the developing roller 41 is controlled. At this time, the supply voltage Vc and the restricting voltage Vb supplied to the feed roller 42 and the toner restricting member 43 provided in the developing apparatus 4 respectively are controlled concurrently.

When the developing roller 41 begins rotating, a command for starting an image forming operation is issued. And, with respect to the command signal, start of the developing roller 41 is controlled. The controlling of the rotation of the developer roller 41 is thus started a predetermined time after the command signal is received.

When the command signal is received, the photosensitive member 1 is also rotated a predetermined time later. Then, the developing apparatus 4 issues a start command so that the developing roller 41 begins rotating.

Since the developing roller 41 begins rotating a predetermined time after the command signal is entered, the developing bias voltage Va is turned ON in response to the entered command signal. Supply of the developing bias voltage Va can thus be controlled before the developing roller 41 begins rotating. In addition, if the developing roller 41 rotates after the photosensitive member 1 begins rotating, supply of the developing bias voltage Va is controlled synchronously with the start of the rotation of the photosensitive member 1.

With such a controlling method, toner carried on the developing roller 41 is kept stable, which prevents scattering of toner caused by blow-out of the one-component toner 10 according to the rotation of the developing roller 41. In other words, when the developing apparatus 4 stands by, no voltage (including the developing bias voltage Va) are supplied. One-component toner 10 carried on the surface of the developing roller 41 is thus not charged. If the developing bias voltage Va is applied to the developing roller 41 before the roller 41 begins rotating, non-charged toner 10 is held on the developing roller 41 statically to prevent blowing out of toner 10, that is, scattering of toner just after the developing roller 41 begins rotating.

When an image forming operation is started and the photosensitive member 1 reaches the developing area, therefore, the developing state is already stabilized and a charged one-component toner 10 is fed according to the rotation of the developing roller 41. The developing process is thus performed stably.

Toner 10 carried on the surface of the developing roller 41 may scatter even when an image forming operation is ended. As shown in FIG. 2B, the developing roller 41 is thus stopped synchronously with the end of the image forming operation. Then, a fixed time after the developing roller 41 stops, the developing bias voltage Va, the supply voltage Vc to the feed roller 42, and the restricting voltage Vb applied to the toner restricting member 43 are all turned off.

If an image forming operation is ended and the developing bias voltage Va is turned off before the developing roller 41 stops or synchronously with the stop of the developing roller 41, toner is sucked strongly toward the developing roller 41. This is because toner is charged. In addition, for example, negatively charged toner 10 is pushed away toward the developing roller 41. This is because the surface of the photosensitive member 1 is charged. Consequently, a filming phenomenon that toner 10 is stuck on the developing roller 41 occurs. As a result, toner 10 is not charged stably, causing stripes to appear in a portion of an image, where the filming appears.

To avoid this problem, therefore, after the developing roller 41 stops, supply of a developing bias voltage Va is prepared so as to be turned on any time as shown in FIG. 2B. Thus, toner 10 is not pushed toward the developing roller 41 any longer and no filming phenomenon occurs. In addition, the charging potentials of the photosensitive member 1 and the charging potentials of toner 10 carried on the developing roller 41 fall gradually, and after those potentials falls, the above problems do not arise even when supply of the developing bias voltage Va to the developing roller 41 is turned off. Thus, the filming phenomenon is avoided.

The developing bias voltage Va supplied to the developing roller 41 is turned on together with the supply voltage Vc to the feed roller 42. Both voltages Va and Vc are turned off together also when an image forming operation is ended. This is to keep unstable non-charged toner carried on the developing roller 41 thereby to prevent scattering of toner when an image forming operation is started. Scattering of toner can thus be prevented when the developing roller 41 stops. And, if the developing bias voltage Va is turned off synchronously with the end of an image forming operation after the developing roller 41 stops, the filming phenomenon to arise from toner is eliminated. In other words, the developing bias voltage Va is turned off when the charging potential of toner 10 falls gradually and the filming phenomenon is suppressed.

Hereunder, the first and second examples will be described focusing on how scattering of toner is caused by blown-out toner and prevented effectively in the first embodiment as described above. Especially, the developing apparatus in the first example was controlled as shown in FIG. 2A and the developing apparatus in the second example was controlled as shown in FIG. 2B.

FIRST EXAMPLE

The developing roller 41 provided in the developing apparatus 4 shown in FIG. 1 was set to 34 mm in diameter and 300 mm/sec in surface speed, that is, the peripheral surface speed of the rotating developing roller 41. The feed roller 42 was set to 20 mm in diameter and 180 mm/sec in surface speed. In addition, the toner restricting member 43 used a phosphorus bronze plate of 0.1 to 0.2 mm in thickness and the plate was pressed against the developing roller 41.

Toner 10 was composed of a polyester non-magnetic one-component toner having negative charging characteristics. Each of voltages supplied to the developing roller 41, the toner restricting member 43, and the feed roller 42 was set to as follows; Va=−350V, Vb=−400V, and Vc=−450V. At this time, an OPC (Organic Photoconductor) was used as the photosensitive member 1 and the surface was charged in uniform to a potential of −600V.

As described above, the timings for starting the rotation of the developing roller 41 and the supply of each of the voltages were as shown in FIG. 2A.

In this example, the developing roller 41 was in contact with the photosensitive member 1 when rotated. In addition, the developing roller 41 was rotated synchronously with the photosensitive member 1. The developing bias voltage Va supplied to the developing roller 41, as well as the restricting voltage Vb and the supply voltage Vc were supplied in response to a command for starting an image forming operation. The developing roller 41 was rotated a fixed time after those voltages Va, Vb, and Vc are supplied.

As a result, toner did not blow out around the toner restricting member 43. In other words, no scattering of toner was recognized. In addition, no scattering of toner was recognized in the collecting area with which the feed roller 42 came in contact while toner was collected into the developing tank 40 according to the rotation of the developing roller 41.

SECOND EXAMPLE

This second example was the same as the first example except that supply of the voltages including the developing bias voltage Va stopped as shown in FIG. 2B when an image forming operation was ended.

When an image forming operation was ended, the developing roller 41 stopped first, then the developing bias voltage Va, the restricting voltage Vb, and the supply voltage Vc were turned off a fixed time after the developing roller 41 stopped. As a result, even when the developing roller 41 stopped, no scattering of toner was recognized at the toner restricting member 43 and at the toner collecting portion.

Second Embodiment

In the first embodiment, the developing bias voltage Va to the developing roller 41 was turned on/off synchronously with driving of the developing roller 41 as well as the on/off of the supply voltage Vc to the feed roller 42 as shown in FIGS. 2A and 2B.

As the developing apparatus of the invention is composed as described above, the developing roller 41 can be controlled synchronously with the on/off timings of the developing bias voltage. Thus, the control circuit can be simplified.

In this embodiment, the supply voltage Vc and the restricting voltage Vb supplied to the feed roller 42 and the toner restricting member 43 respectively are turned on/off asynchronously with the on/off timings of the developing bias voltage Va. This is to prevent scattering of toner effectively.

FIGS. 4A and 4B are timing charts indicating how to control the rotation of the developing roller 41, the feed roller 42, and the toner restricting member 43, as well as how to control the supply of the voltages Va, Vc, and Vb to the developing roller 41, the feed roller 42, and the toner restricting member 43 in the second embodiment.

At first, how to control the developing bias voltage ON/OFF in response to the start of an image forming operation will be described with reference to FIG. 4A. Especially, the timing for turning on the developing bias voltage Va is set identically to that of the first embodiment. In other words, the developing bias voltage Va is turned on before the developing roller 41 begins rotating.

Furthermore, the voltages Vc and Vb are supplied to the feed roller 42 and the toner restricting member 43 before the developing bias voltage Va is supplied to the developing roller 41.

The values of the developing bias voltage Va, the supply voltage Vc, and the toner restricting voltage Vb are set to the same values of those in the first embodiment.

The supply voltage Vc and the restricting voltage Vb are supplied in response to the command signal for starting an image forming operation in the image forming apparatus. A fixed time later, the developing bias voltage Va is supplied to the developing roller 41. Consequently, the developing bias voltage Va is turned on before the developing roller 41 begins rotating as described in the first embodiment, that is, before the rotation start signal is received. The developing bias voltage Va is thus turned on a fixed time before a start command signal for an image forming operation is received and both supply voltage Vc and restricting voltage Vb are turned on, and a signal for starting the rotation of the developing roller 41 is received.

The timings for supplying those voltages Va, Vb, and Vc to the developing roller 41, the feed roller 42, and the toner restricting member 43 are controlled in such a way as to prevent blowing out of toner, especially the scattering of toner, just after an image forming operation is started.

In other words, as shown in FIG. 1, the developing roller 41 carries and feeds toner 10 into the developing area. The developing area is an area where the developing roller 41 and the photosensitive member 1 come in contact with each other. Before an image forming operation is started, therefore, both developing roller 41 and photosensitive member 1 stop. During this time, the charging potential of residual toner 10 falls with time. This is why voltages Vc and Vb are supplied to the feed roller 42 and the toner restricting member 43 before the developing bias voltage Va is supplied to the developing roller 41, thereby non-charged toner around the toner restricting member 43 are held, and it is possible to restrict blowing out of toner to be caused by an air flow generated according to the rotation of the developing roller 41, as well as prevent scattering of toner. In addition, toner 10 are collected by the developing roller 41 in the developing area around the feed roller 42. And, since toner 10 are not charged, toner can be held until they are scraped off. It is thus possible to prevent scattering of toner 10 to be collected around the feed roller 42.

Then, after the developing bias voltage Va is supplied to the developing roller 41, the developing roller 41 begins rotating. The function and effect described in the first embodiment are thus more improved. Consequently, it is possible to prevent scattering of toner effectively when an image forming operation is started. The developing process is thus performed stably.

On the other hand, when an image forming operation is ended, the developing roller 41 is stopped first, then the developing bias voltage Va is turned off, and finally the restricting voltage Vb supplied to the toner restricting member 43 and the supply voltage Vc supplied to the feed roller 42 are turned off as shown in timing chart of FIG. 4B.

According to such the control, the developing bias voltage Va is turned off synchronously with the end of an image forming operation, thereby the same function and effect as those described in the first embodiment are obtained in this embodiment, as well. In addition, since the restricting voltage Vb supplied to the toner restricting member 43, etc. are turned off after the developing bias voltage Va is turned off, toner 10 is held long stably around the toner restricting member 43 and the feed roller 42, thereby scattering of toner is prevented more effectively.

In this second embodiment, the developing bias voltage Va is supplied to the developing roller 41 more shortly as shown in FIGS. 4A and 4B than the developing bias voltage is supplied in the first embodiment shown in FIGS. 2A and 2B. In other words, since the developing bias voltage Va is supplied more shortly while the developing roller 41 is rotating, one-component toner 10 is sucked onto the developing roller 41 shortly when the developing roller 41 is stopped. Thus, occurrence of a filming phenomenon that toner is stuck on the developing roller 41 can be reduced more effectively.

Next, the third example will be described for confirming the effect in this second embodiment.

THIRD EXAMPLE

The third example was the same as the first example except that the voltages including the developing bias voltage Va were turned on/off as shown in FIG. 4A.

At first, the voltages Vb and Vc supplied to the toner restricting member 43 and the feed roller 42 were turned on in response to the start of an image forming operation. A fixed time later, the developing bias voltage Va was supplied to the developing roller 41 before the developing roller began rotating.

As a result, it was confirmed that no toner scattered around the toner restricting member 43 even when the developing roller 41 began rotating, as well as in the area of the feed roller 42 where toner was collected.

FOURTH EXAMPLE

The fourth example was the same as the first example except that the developing roller 41 was driven and the voltages including the developing bias voltage Va were supplied at the timings shown in FIG. 4B.

The developing roller 41 was stopped when an image forming operation was ended. Then, a fixed time later, the developing bias voltage Va was turned off, and in a fixed time, voltages Vb and Vc supplied to the toner restricting member 43 and the feed roller 42 were turned off.

As a result, it was possible to prevent scattering of toner around the toner restricting member 43 and around the collecting area on the feed roller 42 when the developing roller 41 stopped.

In the first and second embodiments, a reversal developing method was described. In this method, the photosensitive member 1, the developing roller 41, one-component toner 10, etc. were charged negatively or a negative voltage was supplied to each of those items. This was to supply a positive voltage as the developing bias voltage and use positively charged toner as one-component toner 10 when the photosensitive member 1 to be charged positively was used.

In the reversal developing method, any of the embodiments described above can be used as is except for the relationship of values among the developing bias voltage Va, the restricting voltage Vb, and the supply voltage Vc. In other words, if the developing apparatus 4 composed as shown in FIG. 1 is used for reversal developing with one-component toner and it is controlled as shown in FIGS. 2A, 2B, 4A and 4B, then scattering of toner can be prevented, as well as the developing process can be performed stably without degradation of image quality.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus using one-component toner, comprising:

a carrier for carrying a static latent image;

a rotatable developing roller opposed to the carrier, for carrying one-component toner and feeding the one-component toner to a developing area of the carrier; and a toner restricting member for restricting an amount of one-component toner to be carried on the developing roller, wherein a restricting voltage is applied to the toner restricting member to move the one-component toner toward the developing roller;

wherein a developing bias voltage is applied to the developing roller to apply one-component toner on the static latent image formed on the carrier, and wherein the developing apparatus is controlled so that the application of the developing bias voltage is started prior to driving of the developing roller.

2. The developing apparatus using one-component toner of claim 1, wherein the developing apparatus is controlled so that application of the restricting voltage is started prior to driving of the developing roller.

3. The developing apparatus using one-component toner of claim 2, wherein the developing apparatus is controlled so that application of a restricting voltage is started prior to the starting of the developing bias voltage.

4. The developing apparatus using one-component toner of claim 1, further comprising a toner feed roller, wherein the developing apparatus is controlled so that application of a supply voltage to the toner feed roller is started in order to feed one-component toner to the developing roller prior to driving of the developing roller.

5. The developing apparatus using one-component toner of claim 4, wherein the supply voltage is varied to adjust an amount of one-component toner fed to the developing roller.

6. The developing apparatus using one-component toner of claim 4, wherein the developing bias voltage Va, restricting voltage Vb and supply voltage Vc are controlled so as to satisfy $|Va| \leqq |Vb| \leqq |Vc|$.

7. A developing apparatus using one-component toner, comprising:

a carrier for carrying a static latent image;

a developing roller opposed to the carrier, for carrying one-component toner and feeding one-component toner to a developing area of the carrier by rotating; and a toner restricting member for restricting an amount of one-component toner to be carried on the developing roller, wherein a restricting voltage is applied to the toner restricting member to move the one-component toner toward the developing roller;

wherein a developing bias voltage is applied to the developing roller to make the one-component toner stick on a static latent image formed on the carrier, and wherein the developing apparatus is controlled so that the application of the developing bias voltage is stopped after the developing roller is stopped.

8. The developing apparatus using one-component toner of claim 7, wherein the developing apparatus is controlled so that the application of the restricting voltage is stopped after the developing roller is stopped.

9. The developing apparatus using one-component toner of claim 7, wherein the developing apparatus is controlled so that the application of the restricting voltage is stopped prior to the stopping of the developing bias voltage.

10. The developing apparatus using one-component toner of claim 7, wherein the developing apparatus further includes a toner feed roller for feeding the one-component toner to the developing roller, wherein a supply voltage is applied to the toner feed roller to feed one-component toner to the developing roller.

11. The developing apparatus using one-component toner of claim 9, wherein the developing bias voltage Va, restricting voltage Vb and supply voltage Vc are controlled so as to satisfy $|Va| \leqq |Vb| \leqq |Vc|$.

12. An image forming device, comprising:

a carrier for carrying a static latent image;

a roller for carrying toner to a developing area of the carrier; and a toner restricting member for restricting an amount of toner carried on the developing roller, wherein a bias voltage is applied to the roller to adhere toner to the static latent image on the carrier, and wherein a restricting voltage is applied to the toner restricting member to move toner toward the roller.

13. The device of claim 12, wherein the image forming device is controlled to apply the bias voltage to the roller prior to applying a driving voltage to the roller.

14. The device of claim 12, wherein the image forming device is controlled to apply the restricting voltage to the toner restricting member prior to applying a driving voltage to the roller.

15. The device of claim 12, wherein the image forming device is controlled to stop application of the bias voltage to the roller after a driving voltage to the roller is stopped.

16. The device of claim 12, wherein the image forming device is controlled to stop application of the restricting voltage to the toner restricting member after a driving voltage to the roller is stopped.

17. The device of claim 12, wherein the image forming device is controlled to apply the restricting voltage to the toner restricting member prior to applying the bias voltage to the roller.

18. The device of claim 12, further comprising a toner feed roller, wherein the image forming device is controlled to apply a supply voltage to the toner feed roller so as to feed toner to the roller.

19. The device of claim 18, wherein the image forming device is controlled to apply the supply voltage to the toner feed roller prior to applying a driving voltage to the roller.

20. The device of claim 18, wherein the supply voltage is varied to adjust an amount of toner fed to the roller.

21. The device of claim 18, wherein the bias voltage Va, restricting voltage Vb and supply voltage Vc are controlled so as to satisfy $|Va| \leqq |Vb| \leqq |Vc|$.

* * * * *